United States Patent [19]

Kaucic

[11] Patent Number: 5,072,685

[45] Date of Patent: Dec. 17, 1991

[54] HYDRAULIC SYSTEM FOR TUG/BARGE CONNECTIONS

[75] Inventor: Robert Kaucic, Newark, Del.

[73] Assignee: Express Marine, Inc., Pennsauken, N.J.

[21] Appl. No.: 541,254

[22] Filed: Jun. 20, 1990

[51] Int. Cl.[5] ..... B63B 21/00

[52] U.S. Cl. ..... 114/249; 114/251

[58] Field of Search ..... 212/163, 164; 114/242, 114/249, 253, 251

[56] References Cited

U.S. PATENT DOCUMENTS

| | | | |
|---|---|---|---|
| 3,461,829 | 8/1969 | Mosvold | 114/249 |
| 3,645,225 | 2/1972 | Lunde | 114/249 |
| 3,756,183 | 9/1973 | Clemence | 114/249 |
| 3,807,575 | 4/1974 | Merrick | 212/163 |

*Primary Examiner*—Jesûs Sotelo

*Assistant Examiner*—Stephen P. Avila

*Attorney, Agent, or Firm*—Austin R. Miller

[57] ABSTRACT

Hydraulic system for controlling tug-barge cables. A closed hydraulic loop is connected to a cylinder and includes a pump to reciprocate the piston and to apply constant tension through the cylinder and piston to the cables.

19 Claims, 6 Drawing Sheets

HYDRAULIC SYSTEM FOR TUG/BARGE CONNECTIONS

BACKGROUND OF THE INVENTION

This invention relates to a system for connecting a barge and tug, particularly to a hydraulic connection system for use with a tug in a pushing configuration against a stern portion of a barge, or even in a towing configuration.

DESCRIPTION OF THE PRIOR ART

Connection systems for barges and tugs have endeavored to adapt in a quick and easy manner for use in a variety of sea conditions. Many of the prior systems have also sought to provide a quick release feature to facilitate separation of the tug and barge.

For example, U.S. Pat. No. 4,072,122 discloses a towline mooring and release system utilizing a combination air pressure and hydraulic fluid system for control of a cylinder. An accumulator reservoir supplies fluid pressure to the working end of the cylinder through two conduits. Fluid pressure is generated by gas from the upper portion of the accumulator.

The fluid pressure establishes a predetermined pressure on one side of the cylinder, which impinges on one side of a piston. Preselected pressures exerted on both sides of the piston permit limited movement of the piston along the length of the cylinder depending upon the tension applied to chains connected to a carriage and extending to the barge. Limited piston movement is often inadequate, however, especially when high seas cause rapid and unpredictable relative movements of the tug and the barge.

U.S. Pat. No. 4,307,678 discloses an open center system including a hydraulic quick release system for tightening and releasing tug/barge cable connections in the event of cable connection breakage. The system includes a pair of hydraulic cylinders mounted on the stern of the tug, with each cylinder having apparatus, including accumulator reservoirs, for actuating the cylinders simultaneously and independently of each other. This system has many of the same severe deficiencies as the U.S. Pat. No. 4,072,122 patent, namely piston movement is frequently inadequate in high seas due to the large and unpredictable relative movements of the barge or tug.

The systems disclosed in the aforementioned U.S. Pat. Nos. 4,072,122 and 4,307,678 encounter problems in lengthening and shortening connecting cables in heavy seas. Indeed, these operations are limited primarily by the capacity of the accumulators in each system; they are capable of providing only constant tension and are further limited in controllability of the accumulators.

These limitations can have a severe impact on the connection between the two vessels. Equipment damage or complete destruction may result in the event heavy seas stress the connection systems beyond their capacities. Moreover, severe injury or death can occur upon connection system failure as loose gear and heavy cables or hawsers whip about.

It is important to understand that barges and tugs utilizing connection systems are usually very large vessels and their movements are frequently unpredictable and difficult or impossible to control, depending on the roughness or movement of the water. For example, in heavy seas, the barge and tug tend to raise and lower relative to each other or to pivot or tilt. Thus, the barge bow and tug stern may swing in one vertical direction while the barge stern and tug bow swing in the opposite vertical direction. The barge and tug also tend to swing horizontally relative to each other depending upon waves, water current and wind. Thus, the barge bow and tug stern may swing to the right or the barge bow may swing to the left while the tug stern swings to the right. Such random action requires sudden and decisive tightening and slackening of the connecting cables. The prior art has not been able to solve this daunting and difficult task.

When sudden tightening force is applied to the connecting cables to counteract the random barge and tug movements, they tend to break or damage the connection equipment. On the other hand, when the cables suddenly slacken, the barge and tug may separate and cause damage to one another, as they are then free to collide.

Also, the arrangement of the carriage and cylinder systems on the tugboat severely hampers activity on the stern of the tugboat. For example, towing operations tend to be inconvenienced by the presence of extensive gear associated with the prior art systems mounted across the stern of the tugboat.

Other prior art known to applicant includes: U.S. Pat. Nos. 2,984,202; 3,362,372; 3,446,173; 3,483,842; 3,645,225; 3,648,226; 3,735,722; 3,802,375; 3,842,781; 3,882,813; 4,026,234; 4,168,672; 4,200,052; 347,801; and 4,759,256.

OBJECTS OF THE INVENTION

It is an object of the invention to provide a connection system capable of easily and quickly connecting and disconnecting a tug and a barge.

It is another object of the invention to provide a tug/barge connection system which securely maintains the proper tension on cables connecting a tug and a barge during varying sea conditions, especially heavy seas.

It is another important object of the invention to provide a tug/barge connection system free of bulky and cumbersome deck gear which permits the reservation of a substantial open working area on the stern of the tug.

Other objects and advantages of the invention will become apparent to those skilled in the art and from the drawings, the detailed description thereof and the appended claims.

SUMMARY OF THE INVENTION

The problems of the prior art are admirably overcome by the present invention which provides a "closed loop" system which can very quickly make large adjustments and individual controls of port and starboard hawsers, all without sacrificing rigorous pressure control.

The present invention utilizes a hydraulic system for connecting a tug and barge. The system, which is a closed hydraulic system, includes a pair of hydraulic cylinders mounted on the tug, which each of the cylinders having a movable piston. A cable connector is fixed to each of the pistons to connect to cables extending from the barge to the tug. Hydraulic fluid moving pumps connect to opposing ends of the cylinders, with the pumps having fluid supply ports connected to one opposing end of the cylinders and fluid withdrawal ports connected to the other opposing end of the cylinders. The pumps supply substantially the same amount of fluid to one end of the cylinders as the pumps withdraw from the other end of the cylinders to reciprocate the pistons. The system also includes a pair of control valves connected between the pumps and the cylinder to control the rate of fluid flow into and out of the cylinders and/or the pressure of fluid flowing into and out of the cylinders, thereby precisely controlling reciprocating movement of the pistons. The system may be operated from the bridge of the tug or at one or more other locations.

DETAILED DESCRIPTION OF THE INVENTION

Figure 1:
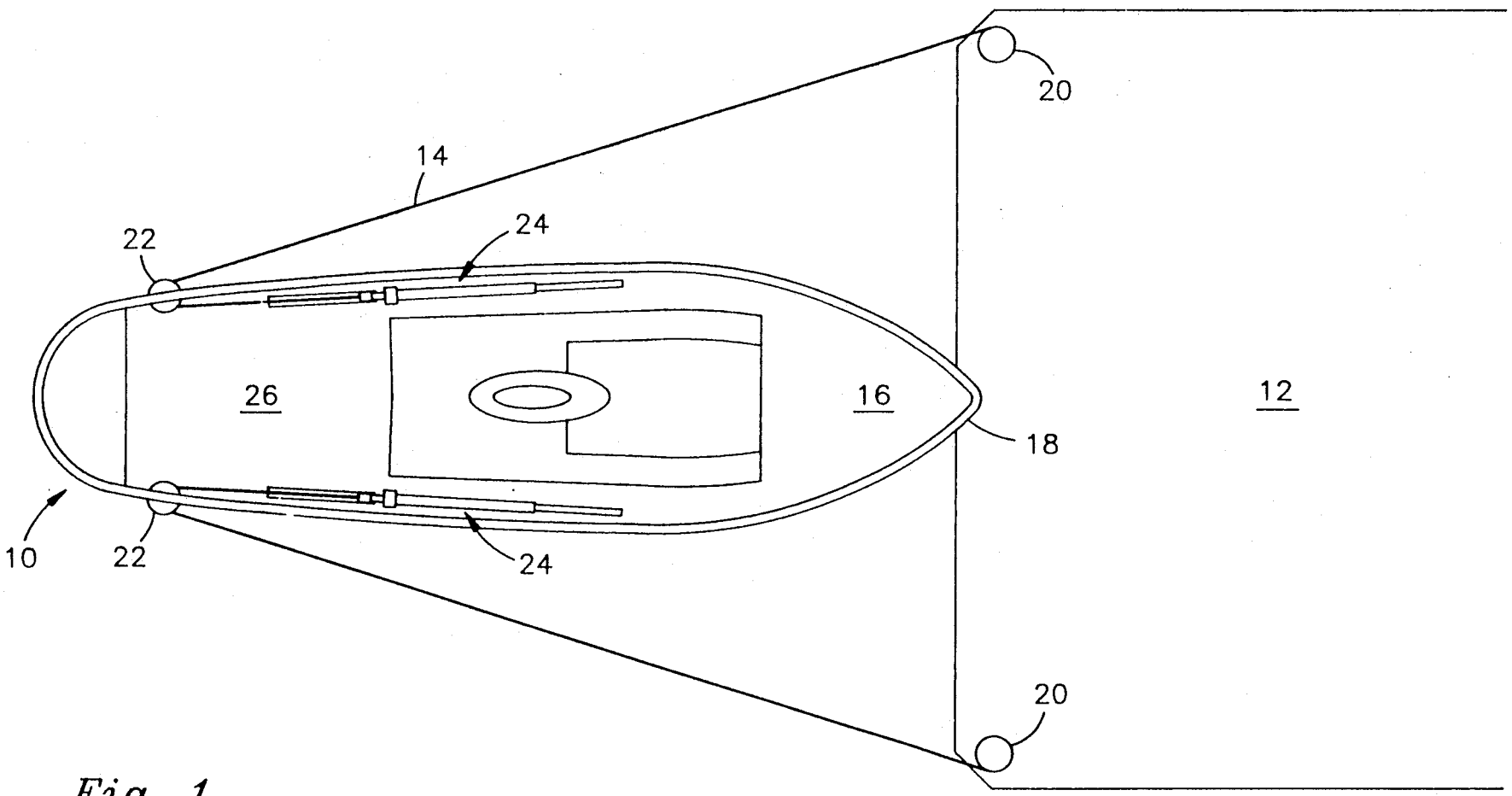
FIG. 1 is a schematic top plan view of a tug and barge connected together by a quick release connection system in accordance with the invention.

Although specific forms of apparatus embodying the invention have been selected for illustration in the drawings, and although specific terminology will be referred to in describing these forms and the description which follows, such use is not intended to limit the scope of the invention, which is defined in the appended claims.

Referring generally to the drawings, and especially referring to FIG. 1, there is shown a tug 10 connected to a barge 12 by cables 14. The bow 16 of tug 10 extends into and contacts notch 18 in barge 12. Cables 14 connect to barge 12 on one end by mounts 20. Cables 14 connect to barge 12 on their other ends by way of sheaves 22 and connectors 24. Connectors 24 are mounted on deck 26 of tug 10.

Figure 2:
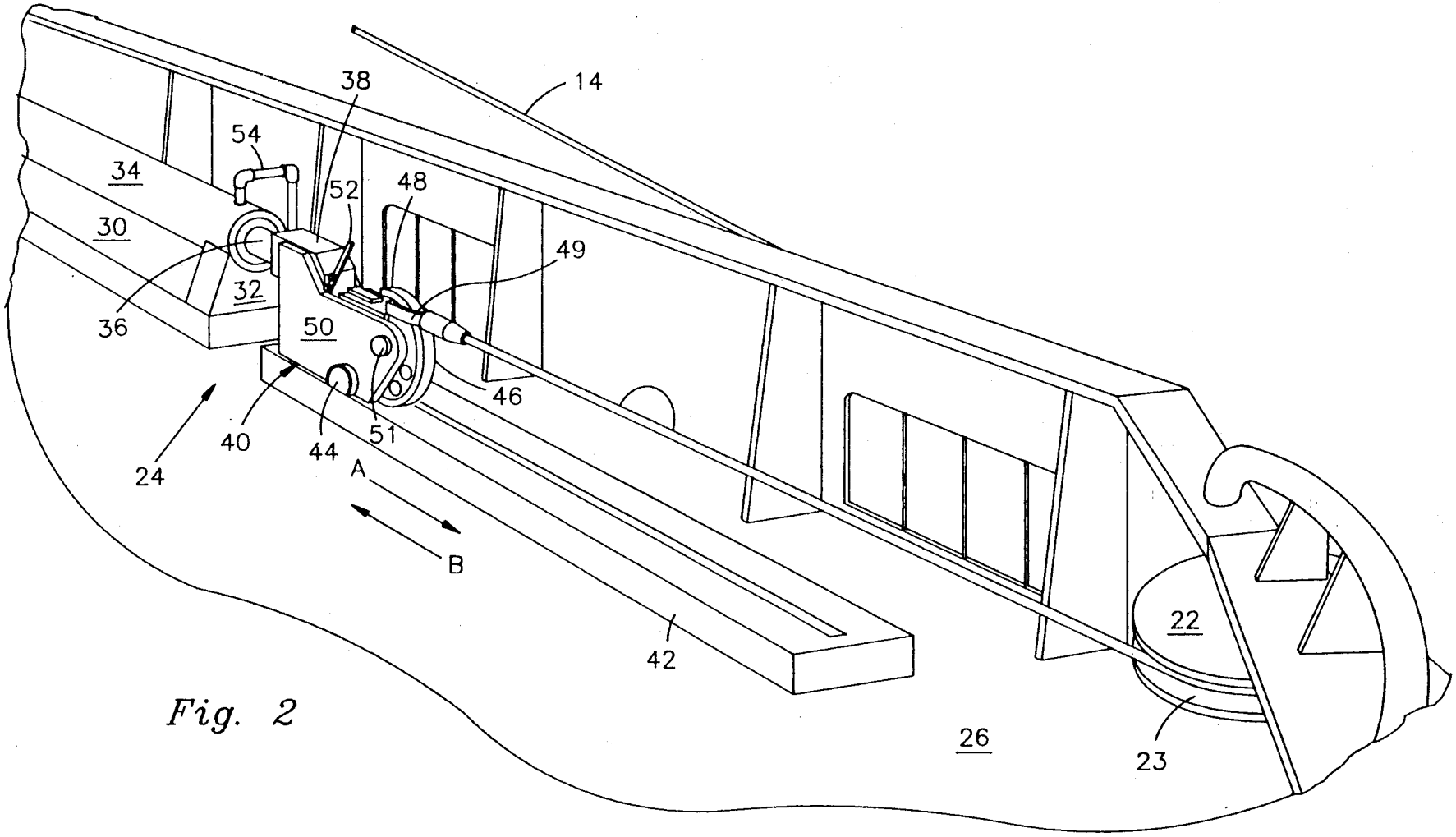
FIG. 2 is a partial perspective view of a hydraulic cylinder and quick release cable connector mounted on a barge and connected to a cable extending from a barge in accordance with aspects of the invention.

Referring now to FIG. 2 of the drawings, an illustrative connector 24 is shown mounted onto deck 26. Cable 14 connects to connector 24, extends through groove 23 in sheave 22 and toward barge 12 (not shown).

Connector 24 comprises a number of component parts. Base 30 lies on deck 26 and has a pair of legs 32 (one of which is not shown) extending upwardly therefrom. Cylinder 34 lies substantially horizontally on legs 32. Cylinder 34 has double ended piston 36 (see FIG. 3) lying axially therewithin. Cylinder fluid line 54 connects to cylinder 34. Carriage connector 38 connects to cable connector carriage 40.

Cable connector carriage 40 lies on trackway 42. Cable connector carriage 40 includes a pair of wheels 44 (one of which is not shown), a connector wheel 46 having a connector hook 48 and carriage housing 50. Connector wheel 46 is rotatably mounted to carriage housing 50 by pin 51. Latch handle 52 is mounted to carriage housing 50. Connector hook 48 engages cable loop 49.

Figure 3:
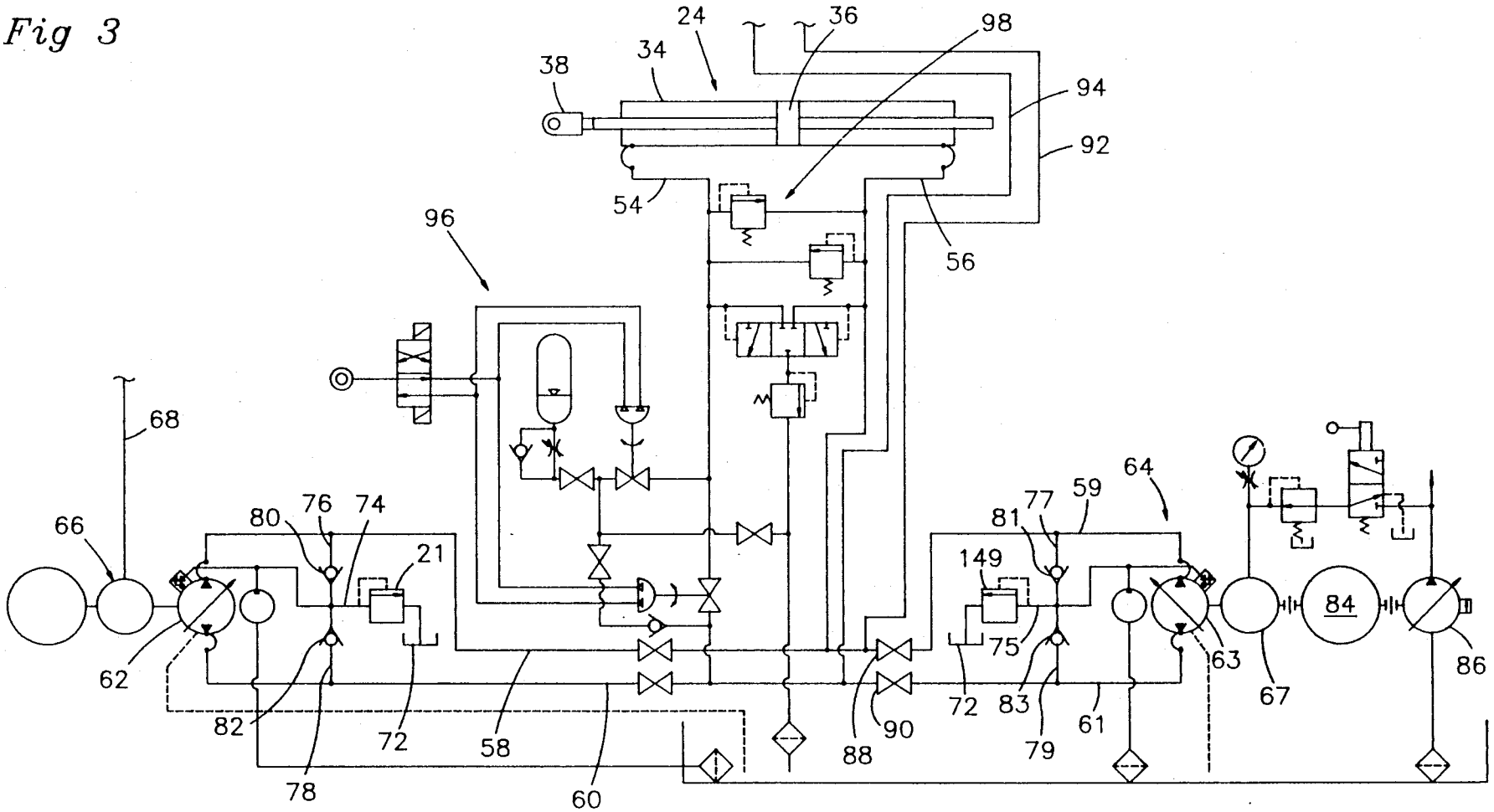
FIG. 3 shows a schematic diagram of a portion of the hydraulic system of the invention regarding one cylinder.

FIG. 3 of the drawings shows a preferred embodiment of the hydraulic system associated with one of connectors 24. As previously discussed with regard to FIG. 2, FIG. 3 shows cylinder 34 having double ended piston 36 and carriage connector 38. Cylinder fluid lines 54, 56 connect to opposing ends of cylinder 34 on one end and pump fluid lines 58, 60, respectively, on the other end. Pump fluid lines 58, 60 connect to main pump 62 on one end and backup pump system 64 on the other end.

Main pump 62 connects to hydraulic clutch 66, which in turn connects to hydraulic supply line 68. Hydraulic supply line 68 ultimately connects to a hydraulic pressure source (partially shown in FIG. 6) derived from the main engine of tugboat 10. Fluid reservoir 72 connects to pump fluid lines 58, 60 through one way valve 21, conduits 74, 76, 78 and check valves 80, 82.

Backup pump system 64 contains backup pump 63, backup hydraulic clutch 67, backup one way valve 149, backup conduits 75, 77, 79 and backup check valves 81, 83 connected together in the same manner as main pump 62, hydraulic clutch 66, one way valve 21, conduits 74, 76, 78 and check valves 80, 82. Backup hydraulic clutch 67 connects to backup motor 84, which further connects to emergency pump 86. Emergency pump 86 connects to an emergency motor (not shown). Backup pump fluid lines 59, 61 connect with pump fluid lines 58, 60, respectively, through normally closed ball valves 88, 90, respectively. Crossover conduits 92, 94 connect to pump fluid lines 58, 60 on one end and to the other half of the hydraulic system (see FIG. 6) on the other end. Leakage and volume correction system 96 connects to cylinder fluid line 54 and is discussed in detail in connection with FIG. 4. Hydraulic transmission system 98, which connects to cylinder fluid lines 54, 56, is discussed in detail in connection with FIG. 5.

Figure 4:
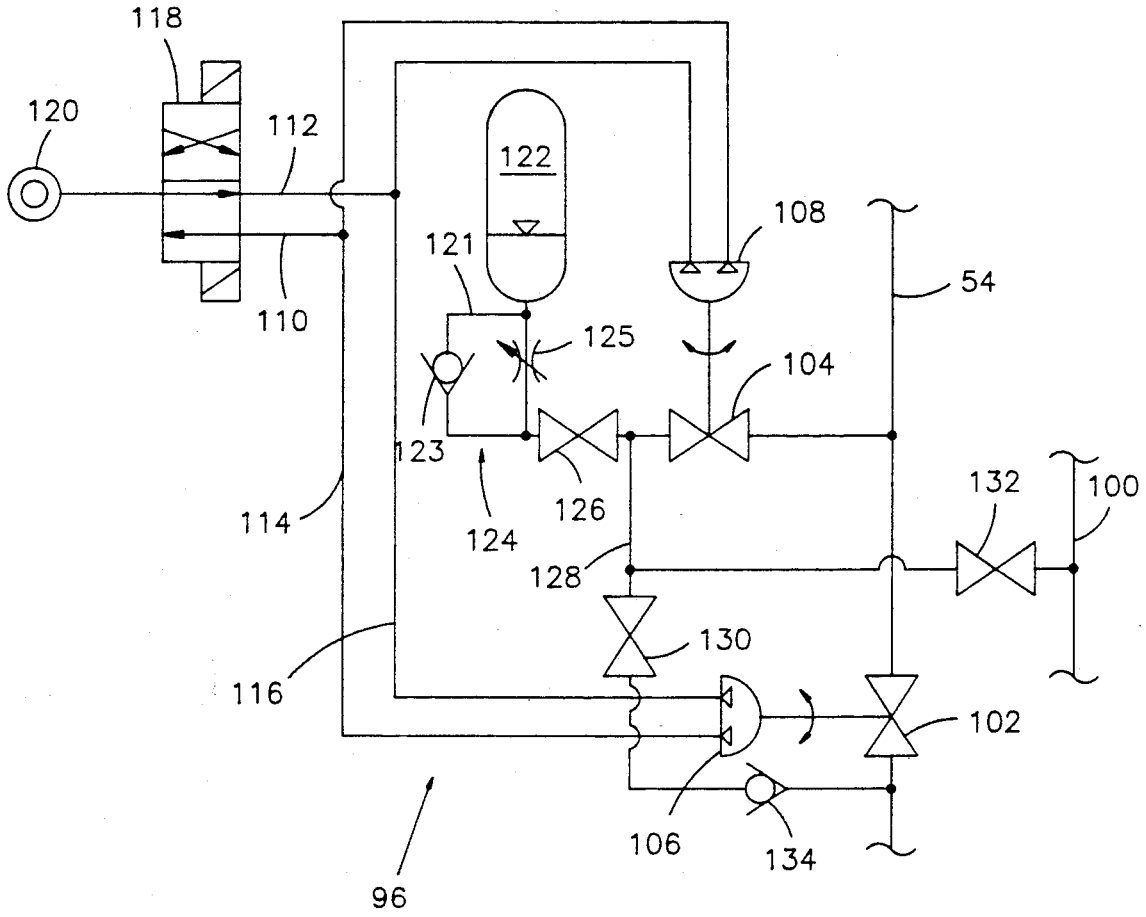
FIG. 4 is an exploded schematic diagram of the accumulator portion of the hydraulic system taken from FIG. 3 and utilized to compensate for system leakage and fluid volume expansion/contraction.

Referring now to FIG. 4 of the drawings, an illustrative leakage and volume correction system 96 is shown. System 96 connects into the remainder of the tugboat hydraulic system through cylinder fluid line 54 and conduit 100 of hydrostatic transmission system 98.

Leakage and volume correction system 96 preferably consists of a hydraulic portion and a pneumatic portion. The pneumatic portion connects to hydraulic valves 102, 104 of the hydraulic system. Valves 102, 104 connect to pneumatic valve actuators 106, 108, respectively. Actuators 106, 108 connect to pneumatic source lines 110, 112 by pneumatic supply lines 114, 116, respectively. Pneumatic switch 118 connects to pneumatic source lines 110, 112 and further connects to pneumatic source 120 on tugboat 10.

The hydraulic portion of leakage and volume correction system 96 consists of accumulator 122, which connects to flow control valve 124. Flow control valve 124 is a loop consisting of gate valve 123, valve 125 and conduit 121. Flow control valve 124 connects to normally open valve 126, which in turn connects to valve 104 and conduit 128. Conduit 128 connects to normally open valves 130, 132. Normally open valve 132 leads to conduit 100 and normally open valve 130 leads to check valve 134, which in turn leads to cylinder fluid line 54.

Figure 5:
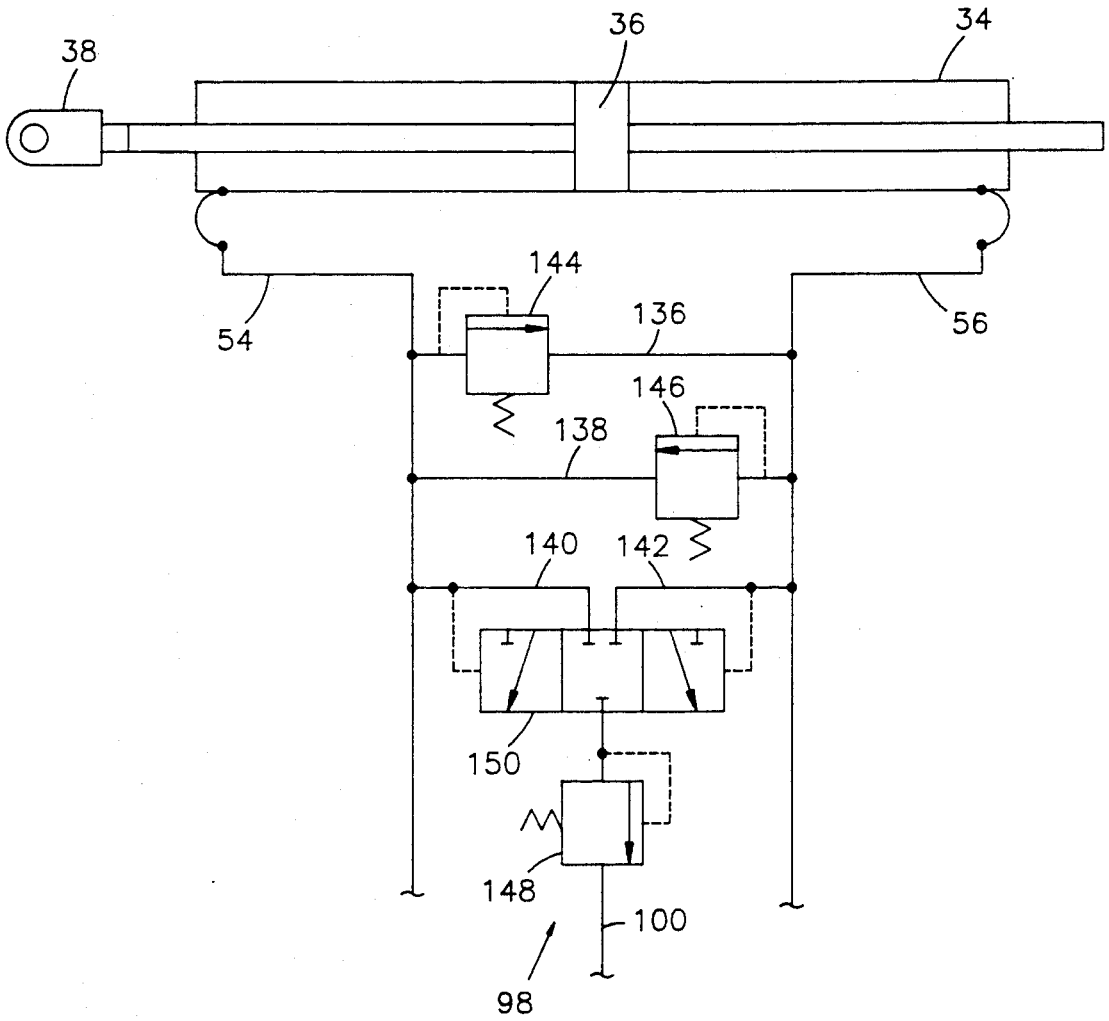
FIG. 5 is an exploded schematic diagram of a hydrostatic transmission valve system taken from FIG. 3 and utilized to relieve pressure in the hydraulic cylinders.

Referring now to FIG. 5 of the drawings, an illustrative hydrostatic transmission system 98 connects to cylinder 34 by way of cylinder fluid lines 54, 56. Cylinder fluid lines 54, 56 are connected by conduits 136, 138, 140, 142. Conduits 140, 142 connect to relief conduit 100. One way pressure relief valves 144, 146, 148 are located along conduits 136, 138, 100 respectively. Double relief valve 150 connects to conduits 140, 142, 100.

Figure 6:
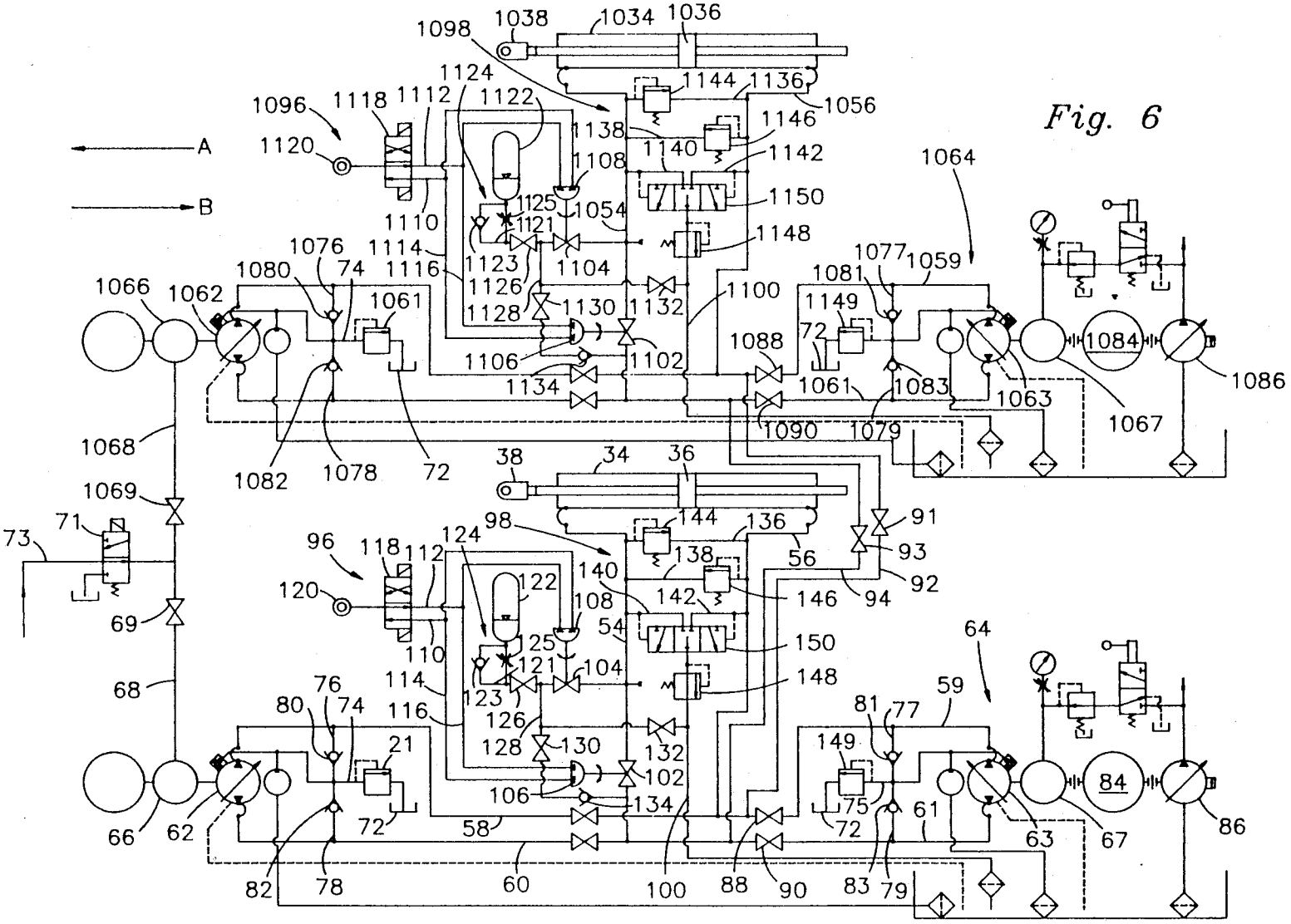
FIG. 6 shows a schematic diagram of the entire hydraulic system of the invention, including the system of FIG. 3 and crossover connections.

Referring now to FIG. 6 of the drawings, one example of an entire hydraulic system utilizing features of the invention is shown. The portion of the system in the bottom half of FIG. 6 corresponds directly to the system shown in FIG. 3. The portion of the system in the upper half of FIG. 6 is a mirror image of the structure shown in FIG. 3 and contains related numerical labels, except that the numerals in the corresponding structure in the upper half of FIG. 6 have been increased by one thousand. (For example, hydraulic clutch 66 in FIG. 3 and the lower half FIG. 6 corresponds to hydraulic clutch 1066 in the upper half of FIG. 6.) It should be understood that although the discussion below describes simultaneous use of both halves of the system, that either half may be utilized independently of the other if desired.

The halves of the system connect together by crossover conduits 92, 94, which have normally closed crossover valves 91, 93, respectively. The halves further connect by conduits 68, 1068, which have normally open hydraulic valves 69, 1069, respectively. Hydraulic supply valve 71 connects to hydraulic motor supply line 73, which is located between the tug engine and hydraulic supply lines 68, 1068.

Referring now to the drawings in general, the preferred method of operation of the apparatus of the invention will now be described. Tug 10 approaches barge 12 and the two contact by placing tugboat bow 16 into barge notch 18. Cables 14, which connect to mounts 20 of barge 12, are taken on board tug 10 and threaded through sheaves 22 and hooked onto connectors 24. Cables 14 represent any number of possible tug/barge connectors known in the art. For example, cables 14 can be wire, chain, hemp rope, synthetic line and the like.

FIG. 2 shows a connected cable 14 in a tensioned position. To connect a cable 14 to a cable connector carriage 40, it is preferred to actuate cylinder 34, thereby causing cable connector carriage 40 to move in the direction shown by arrow A along trackway 42. This permits sufficient slack for cable loop 49 to engage connector hook 48. Cable 14 may then be tensioned by actuating cylinder 34, thereby causing cable connector carriage 40 to move along trackway 42 in the direction shown by arrow B. Both connectors 24 shown in FIG. 1 are actuated in this manner to securely connect tug 10 and barge 12.

A similar operation may be used to release tug 10 from barge 12. Such release may occur in two ways. One manner is to release cables 14 when they are in a tensioned state. (However, this is not recommended for safety reasons.) This may be achieved by actuating latch handle 52, which in turn causes connector wheel 46 to rotate about pin 51 in a clockwise manner. Rotation of connector wheel 46 causes connector hook 48 to similarly rotate such that cable loop 49 is free to disconnect. This type of release is intended for emergency purposes only, since cable 14 would be free to "whip" on its loose end and since tug 10 and barge 12 would suddenly be free from connection.

Another manner to release cable 14 is to actuate cylinder 34, which causes cable connector carriage 40 to move in the direction shown by arrow A. This gradually relieves tension in cable 14. Then, latch handle 52 is actuated to permit rotation in the counterclockwise direction of connector wheel 46. Such rotation by connector wheel 46 permits cable loop 49 to disengage connector hook 48 in a safe manner.

The hydraulic system shown in FIGS. 3-6 preferably operates in the following way to actuate cylinders 34, 1034. The main engine of tug 10 provides primary hydraulic pressure to the system. This pressure is supplied through hydraulic motor supply line 73 to hydraulic supply lines 68, 1068. Flow of fluid in these lines is controlled by hydraulic supply valve 71, which is pneumatically operated, and by normally open hydraulic valves 69, 1069. Hydraulic fluid flows to hydraulic clutches 66, 1066 and to main pumps 62, 1062. Depending upon whether the operator wishes to cause pistons 36 and 1036 to reciprocate in the direction shown by arrows A or B in FIG. 2 of the drawings, pumps 62, 1062 cause fluid to flow in conduits 58, 1058 or conduits 60, 1060, but not both. In the case where the operator wishes to tension cable 14, piston 36 is caused to move in the direction shown by the arrow B. In such case, pumps 62, 1062 supply hydraulic fluid to lines 60, 1060 and, simultaneously, causes hydraulic fluid to be withdrawn, in substantially the same amount, from pump fluid lines 58, 1058. Fluid flows along pump fluid lines 60, 1060 and into cylinder fluid lines 54, 1054. Fluid then enters cylinder 34 on the left side as depicted by the drawings, thereby forcing piston 36 in the direction shown by arrow B.

At the same time, a similar amount of fluid is flowing outwardly from the right side of cylinders 34, 1034 and into cylinder fluid lines 56, 1056. That fluid then travels into pump fluid lines 58, 1058, respectively.

It is an important and advantageous feature of the invention that pistons 36, 1036 may be reciprocated along all points of cylinders 34, 1034 to any degree desired, at variable rates. The system is especially capable of reciprocating pistons 36, 1036 at such variable rates by controlling the rate of fluid simultaneously supplied to one end of the cylinders and withdrawn from the other end of the cylinders as well as the pressure at which the fluid is simultaneously supplied and withdrawn.

Once the pistons have moved to a desired point, the operator actuates pneumatic source 120, 1120 to cause shutoff valves 102, 1102 to close. Closure of shutoff valves 102, 1102 "locks" the system by stopping hydraulic fluid flow. The stopped and isolated hydraulic fluid prevents further movement of pistons 36, 1036, which results in locking pistons 36, 1036 into an exact desired position.

Shutoff valves 102, 1102 are actuated through pneumatic switches 118, 1118, which force air through pneumatic source lines 112, 116 and cause pneumatic valve actuators 106, 1106 to rotate shutoff valves 102, 1102 into a closed position. At the same time, pneumatic air flows from pneumatic valve actuators 106, 1106 back toward pneumatic switches 118, 1118 and through pneumatic supply lines 114, 1114 and pneumatic source lines 110, 1110.

Actuation of pneumatic switches 118, 1118 simultaneously causes pneumatic air to travel through pneumatic supply lines 116, 1116 to pneumatic valve actuators 108, 1108. Air flowing to pneumatic valve actuators 108, 1108 causes shutoff valves 104, 1104 to rotate into an open position. This permits accumulators 122, 1122 to supply small quantities of hydraulic fluid to cylinder fluid lines 54, 1054 by way of flow control valves 124, 1124.

Supply of small, limited quantities of hydraulic fluid from accumulators 122, 1122 is a further important and advantageous feature of the invention. These accumulators 122, 1122 are intended to supply a small amount of hydraulic fluid to the system to compensate for leakage that naturally occurs while the system is "locked" in its "closed loop" position and to compensate for expansion/contraction of hydraulic fluid depending upon temperature. This supply of hydraulic fluid ensures that pistons 36, 1036 remain in a constant position over time. Accumulators 122, 1122 do not supply fluid during movement of pistons 36, 1036 when the system is in an "open" mode because they are isolated by shutoff valves 102, 1102 and 104, 1104.

Accumulators 122, 1122 further serve as a reservoir to relieve excessive pressure in cylinder fluid lines 54, 1054 by way of conduits 128, 1128. This is permitted by way of gate valves 134, 1134 and normally open valves 130, 1130.

The system further contains hydrostatic transmission systems 98, 1098 which serve as pressure relief mechanisms for fluid supply lines 54, 1054, 56, 1056. It has been discovered that the presence of this system is important to alleviate brief but large fluid pressure build ups caused by sudden tensioning of cables 14, especially when tug 10 and barge 12 encounter heavy seas. Large waves typically cause tug 10 and barge 12 to move with respect to one another, thereby resulting in application of greatly increased tension upon cables 14, which in turn tensions the pistons 36, 1036. This causes local hydraulic fluid pressure increase in the system. Such pressure increase is relieved by the ability of the system to transfer hydraulic fluid from cylinder fluid lines 54, 1054 to cylinder fluid lines 56, 1056, respectively. This is achieved through one-way relief valves 144, 1144 and through conduits 136, 1136, respectively. Similarly, excessive pressure increase in cylinder fluid lines 56, 1056 may be released into cylinder fluid lines 54, 1054, respectively through one-way relief valves 146, 1146 by way of conduits 138, 1138, respectively.

In the event that the localized pressure is sufficiently high to cause overload of the previously described relief mechanisms, double relief valves 150, 1150, in combination with one way relief valves 148, 1148, permit fluid release into relief conduits 100, 1100 by way of conduits 140, 1140, 142, 1142, respectively. Pressure relief for accumulators 122, 1122 is also provided for release into relief conduits 100, 1100 through normally open valves 132, 1132, respectively.

Movement of pistons 36, 1036 is typically controlled by a control panel (not shown) located in the bridge, although controls may be located at other suitable positions, such as on a lower deck of the tug. The controls connect to all aspects of the system for completely remote operation. An advantageous capability of the hydraulic system which may be manipulated by the controls is the ability to precisely control the pressure of the hydraulic fluid in cylinders 34, 1034. Thus, the operator may change the pressure of the system from 900 psi to 1000 psi, for example, if desired. Similarly, the operator may control the flow rate of hydraulic fluid in the system. Similarly, the flow rate may be changed from 100 gal/min to 150 gal/min, for example, or maintained at 125 gal/min.

Moreover, the controls can independently vary or maintain the starboard side portion of the system or the port side portion of the system if desired. It is important that the cable tension be high enough to maintain a tight fit of bow 16 in notch 18 of barge 12, but well below the breaking tension. Controlling the pressure in the system and/or the fluid flow rate permits such precise control of the tension applied to the cables.

The system further provides for a series of backup capabilities in the event that a portion of the system fails. For example, crossover conduits 92, 94 permit hydraulic fluid to travel from one half of the system to the other. Such crossover of hydraulic fluid is controlled through crossover valves 91, 93, which may be actuated when needed, but are normally closed. The system further contains backup pumps 63, 1063, which connect to backup motors 84, 1084, through backup hydraulic clutches 67, 1067. Emergency pumps 86, 1086 connect to a pair of emergency motors (not shown), which are typically deck mounted gasoline engines independently operable from the remaining systems of tugboat 10. Backup pump systems 64, 1064 accordingly have double backup features.

Hydraulic fluid supplied through either backup pump 63, 1063 or emergency pumps 86, 1086 flows through backup pump fluid lines 59, 61 through normally closed ball valves 88, 90, respectively, and into cylinder fluid lines 54, 1054, 56, 1056. Normally closed ball valves 88, 1088 and 90, 1090 normally isolate backup pump system 64, 1064 from the remainder of the hydraulic system. Normally closed ball valves 88, 1088 and 90, 1090 are opened only upon the need of backup or emergency hydraulic fluid.

Backup pump systems 64, 1064 have separate pressure relief systems which lead to reservoir 72 through backup conduits 75, 1075 and one way relief valves 149, 1149. Backup conduits 77, 1077 and 79, 1079 permit further flow of hydraulic fluid to backup pump fluid lines 59, 1059 and 61, 1061 through backup check valves 81, 1081 and 83, 1083.

The entire hydraulic system further contains various hydraulic fluid filters and a cooling system to assist in keeping hydraulic fluid within a desired temperature range.

Although this invention has been described in connection with specific forms thereof, it will be appreciated that wide arrays of equivalents may be substituted for the specific elements shown and described herein without departing from the spirit and scope of this invention as described in the appended claims.

I claim:

1. A hydraulic system adapted to be mounted on a tug or barge and connected to a tug-to-barge connection for tightening and slacking said connection, comprising:

a closed-loop hydraulic driving means connected to move a portion of said connection extending between said barge and said tug forcibly back and forth for maintaining constant tension on the connection to compensate for forces having a tendency for tightening or slacking the same;

said hydraulic driving means including hydraulic pumping means having a hydraulic inlet and a hydraulic outlet connected by interconnecting means for forcibly moving said hydraulic fluid and said connection back and forth to urge said connection in a tightening or slacking direction to maintain a constant tension on said connection; and said hydraulic interconnecting means forming a closed hydraulic loop with hydraulic fluid trapped in the loop between said hydraulic driving means, said hydraulic inlet, said hydraulic outlet and said hydraulic interconnecting means.

2. A quick-release hydraulic vessel to vessel connection system comprising:

a double-ended hydraulic cylinder carried by one of said vessels, said cylinder having a reciprocally movable piston;

cable connection means fixed to said piston for quick and releasable connection of a cable extending from the other of said vessels to the first vessel;

hydraulic conductors connected to opposing ends of said cylinder in a closed loop including pump means connected into said closed loop to cause reciprocation of said piston by actively supplying and actively withdrawing substantially the same amount of fluid to and from said opposing ends of said cylinder, said pump means including means for controlling the rate of passage of fluid into and out of said cylinder;

valve means connected into said closed loop and connected between said pump means and said cylinder for releasably and adjustably fixing the degree of reciprocation of said piston; and auxiliary fluid supply means for supplying fluid to said cylinder when said piston is at a desired point of reciprocation to compensate for fluid pressure at said cylinder.

3. The system defined in claim 2 further comprising pressure relief means connected to said cylinder for relieving excess fluid pressure in said cylinder caused by sudden tension applied against said cable and piston or sudden release of tension from said cable and piston.

4. The system defined in claim 2 further comprising an emergency pump connected between said pump means and said cylinder.

5. The system defined in claim 4 further comprising an emergency motor connected to said emergency pump.

6. The system defined in claim 2 wherein said pump means connect to the main engine of said first vessel.

7. The system defined in claim 2 further comprising an air operated control valve which automatically activates said auxiliary fluid supply means upon complete closure of said valve means.

8. The system defined in claim 2, wherein said pump means further controls the pressure of said fluid in said cylinder.

9. A quick-release hydraulic vessel to vessel connection system comprising:

a double-ended hydraulic cylinder carried by one of said vessels, said cylinder having a reciprocally movable piston;

cable connection means fixed to said piston for quick and releasable connection of a cable extending from the other of said vessels to the first vessel;

hydraulic conductors connected to opposing ends of said cylinder in a closed loop including pump means connected into said closed loop to cause reciprocation of said piston by actively supplying and actively withdrawing substantially the same amount of fluid to and from said opposing ends of said cylinder, said pump means including means for controlling the pressure of said fluid in said cylinder;

valve means connected into said closed loop and connected between said pump means and said cylinder for releasably and adjustably fixing the degree of reciprocation of said piston; and auxiliary fluid supply means for supplying fluid to said cylinder when said piston is at a desired point of reciprocation to compensate for fluid pressure at said cylinder.

10. The system defined in claim 9 further comprising pressure relief means connected to said cylinder for relieving excess fluid pressure in said cylinder caused by sudden tension applied against said cable and said piston or sudden release of tension from said cable and said piston.

11. The system defined in claim 9 further comprising an emergency pump connected between said pump means and said cylinder.

12. The system defined in claim 11 further comprising an emergency motor connected to said emergency pump.

13. The system defined in claim 9 wherein said pump means connect to the main engine of said first vessel.

14. The system defined in claim 9 further comprising an air operated control valve which automatically activates said auxiliary fluid supply means upon complete closure of said valve means.

15. The system defined in claim 9, wherein said pump means further controls the rate of passage of fluid into and out of said cylinder.

16. A quick release hydraulic system for connecting a tug and barge together comprising:

a pair of hydraulic cylinders mounted on said tug, each of said cylinders having a movable piston;

a cable connector fixed to each of said pistons to connect cables attached to said barge and to said tug;

a pair of hydraulic fluid moving pumps connected to move said cylinders, each of said pumps having a port connected to move one opposing end of said cylinders to supply and withdraw fluid and a port connected to move the other opposing end of said cylinders to supply and withdraw fluid, said pumps simultaneously supplying substantially the same amount of fluid to move the one end of said cylinders as said pumps withdraw to move the other end of said cylinders to positively reciprocate said pistons, said pumps controlling the rate of fluid flow into and out of said cylinders and the pressure of said fluid in said cylinders, thereby precisely controlling reciprocating movement of said pistons; and control valve means forming a closed loop and connected between said pumps and said cylinders to releasably lock said pistons at a desired point of reciprocation.

17. The system defined in claim 16 further comprising cross over valve means connected between said pumps to supply fluid to both of said cylinders upon failure of one of said pumps.

18. The system defined in claim 16 wherein one cylinder is located on the starboard of said tug and the other cylinder is located on the port side of said tug.

19. The system defined in claim 16 wherein said cylinders are positioned parallel to axis extending from the bow to the stern of said tug.

* * * * *